US012697649B2

(12) United States Patent
Duscher

(10) Patent No.: US 12,697,649 B2
(45) Date of Patent: Aug. 4, 2026

(54) PROCESSING MACHINE, WORKPIECE TABLE AND METHOD FOR PROCESSING A WORKPIECE

(71) Applicant: EVOBEND GmbH, Ainring (DE)

(72) Inventor: Nikolaus Franz Duscher, Bergheim (AT)

(73) Assignee: EVOBEND GmbH, Ainring (DE)

( * ) Notice: Subject to any disclaimer, the term of this patent is extended or adjusted under 35 U.S.C. 154(b) by 278 days.

(21) Appl. No.: 18/577,239

(22) PCT Filed: Jun. 28, 2022

(86) PCT No.: PCT/EP2022/067725
§ 371 (c)(1),
(2) Date: Jan. 5, 2024

(87) PCT Pub. No.: WO2023/280635
PCT Pub. Date: Jan. 12, 2023

(65) Prior Publication Data

US 2024/0238860 A1 Jul. 18, 2024

(30) Foreign Application Priority Data

Jul. 7, 2021 (DE) ..... 10 2021 117 488.0

(51) Int. Cl.
*B21D 5/16* (2006.01)

(52) U.S. Cl.
CPC ..... *B21D 5/16* (2013.01)

(58) Field of Classification Search
CPC ..... B21D 5/16; B21D 5/04; B21D 5/042
See application file for complete search history.

(56) References Cited

U.S. PATENT DOCUMENTS

2021/0046533 A1* 2/2021 Kern ..... B21D 5/042

FOREIGN PATENT DOCUMENTS

CN 110303077 B 9/2020
DE 19901797 A1 7/2000
(Continued)

OTHER PUBLICATIONS

Screen captures from YouTube video clip entitled "Thalmann TD Automation, Double folder, Piegartice, Plegadora, Plieuse, Viradeira, 折弯机," 1 page, uploaded on Jun. 24, 2021 by user "Marco Cappello." Retrieved from Internet: https://www.youtube.com/watch?v=QnJ8Hcglpxo.

(Continued)

*Primary Examiner* — Teresa M Ekiert
(74) *Attorney, Agent, or Firm* — Lee Sullivan Shea & Smith LLP

(57) ABSTRACT

The invention relates to a machine tool (10), in particular a long folding machine, for machining a workpiece (12) made of flat material such as sheet metal, comprising: a workpiece table (14) defining a supporting area (16) on which the workpiece (12) can be placed at least in sections during machining; and at least one machining unit (18) for machining the workpiece (12). The workpiece table (14) comprises at least one table assembly (20) having a base plate (22) and a swivel plate (24), the base plate (22) and the swivel plate (24) each defining a portion of the supporting area (16), wherein the swivel plate (24) is pivotably mounted relative to the base plate (22) in such a way that a swivel movement of the swivel plate (44) can be generated for turning the workpiece (12) over. The invention further relates to a workpiece table and a method for machining a workpiece made of flat material.

17 Claims, 8 Drawing Sheets

(56) References Cited

FOREIGN PATENT DOCUMENTS

| | | | |
|---|---|---|---|
| DE | 10358100 | A1 | 7/2005 |
| DE | 102018000344 | B3 | 5/2019 |
| DE | 102021117488 | A1 | 1/2023 |
| EP | 1797973 | A1 | 6/2007 |
| EP | 2014381 | B1 | 11/2012 |
| EP | 3778048 | A1 | 2/2021 |
| EP | 3778049 | A1 | 2/2021 |
| EP | 3013492 | B1 | 8/2021 |
| WO | 2014206817 | A1 | 12/2014 |

OTHER PUBLICATIONS

Screen captures from YouTube video clip entitled "Variobend Doppelbieter Wendevorrichtung," 1 page, uploaded on Dec. 21, 2018 by user "Variobend." Retrieved from Internet: https://www.youtube.com/watch?v=IJtcBh_U_jA.

Screen captures from YouTube video clip entitled "Wall panel produced with Jorns JHS handling system," 1 page, uploaded on Jan. 25, 2019 by user "jornsswiss." Retrieved from Internet: https://www.youtube.com/watch? v=0PcxtS-9smA.

PCT International Searching Authority, International Search Report and Written Opinion mailed on Oct. 19, 2022, issued in connection with International Application No. PCT/EP2022/067725, 19 pages.

German Patent Office, German Search Report and Translation mailed on Oct. 7, 2019, issued in connection with European Application No. 102021117 488.0, 14 pages.

* cited by examiner

PROCESSING MACHINE, WORKPIECE TABLE AND METHOD FOR PROCESSING A WORKPIECE

CROSS REFERENCE TO RELATED APPLICATIONS

This application is a national stage application under 35 U.S.C. § 371 of International Application No. PCT/EP2022/067725, filed Jun. 28, 2022, which claims the benefit of priority from German Application No. 10 2021 117 488, filed Jul. 7, 2021. The disclosures of all of the above applications are incorporated by reference herein in their entireties.

The invention relates to a machine tool, in particular a sheet metal forming machine, a workpiece table and a method for machining a workpiece.

Various machine tools for machining workpieces made of flat material, such as sheet metal, are known from the prior art. Such machine tools may, for example, be provided for machining through forming and/or cutting. Bending machines, presses and punching machines are just a few examples.

Long folding machines are usually used to manufacture profiles. Such machines can be swivel bending machines which are capable of bending a workpiece held between bending jaws by controlled swiveling of a machining tool around a bending axis. Such machines are known, for example, from EP 2 014 381 B1 or DE 199 01 797 A1.

DE 10 2018 000344 B3 further discloses a bending machine having similarly constructed clamping jaws but a different bending mechanism. Base elements that are linearly movable are arranged on the clamping jaws. In turn, bending tools are attached to the base members and can be moved linearly relative to the base members. Superimposing two linear movements makes it possible to freely adapt and precisely move along movement curves of the bending tool.

Depending on the target geometry of the machined workpiece, it may be necessary to turn the workpiece over during the machining process, i.e. to turn its bottom side up and its top side down. In many cases, this is done manually by the machine's operator, which is time-consuming and may provoke operating errors.

In addition, various turnover devices are known which are used to turn workpieces over automatically. A first known turnover device is configured as a separate machine arranged opposite a workpiece holder of a long folding machine. Such a turnover device is used by Jorns, for example, as can be seen in a video available at https://www.youtube.com/watch?v=0PcxtS-9smA. The long folding machine has a workpiece table that is extendable between the bending jaws from a receiving area within which the workpiece to be machined is arranged during bending. When the workpiece table is extended, the workpiece is moved towards the turnover device. Then, the entire workpiece is in front of the clamping jaws and can be picked up by the grippers of the turnover device. The workpiece is then turned over and put back onto the extended workpiece table. After turnover, the previous top side is at the bottom and the previous bottom side is at the top. The workpiece table can then be retracted so that the workpiece is again positioned in the receiving area for further machining.

Another known turnover device is integrated into a long folding machine. Grippers and/or suction cups are arranged on an upper bending tool that, in turn, is attached to an upper clamping jaw. An example of a commercially available turnover device of this type is the "sheet metal flipping unit" by Thalmann, the functionality of which is demonstrated in a video available at https://www.youtube.com/watch?v=xQIuWyKwc6A. This variant also uses an extendable workpiece table. In the extended state, the entire workpiece is outside the receiving area. To turn the workpiece over, the bending tool is swiveled forwards so that the grippers attached to it come into contact with the top side of the workpiece. The top side is gripped and the workpiece is swiveled back together with the bending tool, rotating the workpiece already by more than 90 degrees into a state in which it is partially turned over. Subsequently, the workpiece is released and slides back onto the workpiece table from the state in which it is partially turned over. As in the state in which the workpiece is partially turned over the previous top side is already pointing downwards, the workpiece falls onto the previous top side, which forms the new bottom side as a result. The workpiece comes to rest on the workpiece table fully turned over. The workpiece table can then be retracted.

A turnover device that is arranged within receiving area of a long folding machine is also known from the prior art. ASCO uses such a turnover device, which can be seen in a video available at https://www.youtube.com/watch?v=IJtcBh_UjA. Grippers of the turnover device are arranged within the receiving space and protrude from between table assemblies. To perform a turnover, an upper clamping jaw is swiveled upwards to create space inside the machine. The turnover then takes place in the enlarged receiving space by moving the grippers appropriately.

Depending on the turnover device used, turning the workpiece over may be difficult if a particular large workpiece is used. In addition, the edges of the workpiece may become bent if the workpiece is released before being deposited completely. Hence, there are restrictions for certain workpieces and certain workpiece geometries that may make turning the workpiece over difficult or impossible.

Although there are various variants of turnover devices, based on the prior art, hence there continues to be a need for an option of being able to turn a workpiece over in a manner that is as controlled, damage-free and reliable as possible.

According to the invention, this task is solved by a machine tool, a workpiece table and a method according to the independent claims. Further embodiments can be found in the dependent claims.

According to the invention, a machine tool for machining a workpiece made of flat material may comprise a workpiece table defining a supporting area on which the workpiece can be placed at least in sections during machining. In addition, the machine tool may comprise a machining unit for machining the workpiece. Machining may be performed while the workpiece is placed on the supporting area. The workpiece table may comprise at least one table assembly having a base plate and a swivel plate, wherein the base plate and the swivel plate each define a portion of the supporting area and wherein the swivel plate is pivotably mounted relative to the base plate in such a way that a swivel movement of the swivel plate can be generated for turning the workpiece over.

According to the invention, a workpiece table for a machine tool defines a supporting area on which a workpiece can be placed during machining in such a way that the workpiece rests on the supporting area at least in sections. The workpiece table may comprise a table assembly having a base plate and a swivel plate, wherein the base plate and the swivel plate each define a portion of the supporting area and wherein the swivel plate is pivotable relative to the base plate, in particular automatically, in such a way that a swivel movement for turning the workpiece over can be generated. The workpiece table may be a workpiece table for a machine tool according to the invention.

The invention may further relate to a method for machining a workpiece made of flat material using a machine tool. The machine tool comprises a workpiece table defining a supporting area on which the workpiece can be placed at least in sections during machining, wherein the machine tool further comprises at least one machining unit for machining the workpiece and wherein the workpiece table (14) comprises at least one table assembly having a base plate and a swivel plate, wherein the base plate and the swivel plate each define a portion of the supporting area and wherein the swivel plate is pivotally mounted relative to the base plate. The method may comprise placing the workpiece onto the supporting area. The method may further include machining the workpiece. In addition, the method may comprise generating a swivel movement of the swivel plate in order to turn the workpiece over. The method may further comprise machining the turned-over workpiece. In particular, the method is performed with a machine tool according to the invention and/or with a workpiece table according to the invention.

The features of the invention make it possible to turn a workpiece over in a controlled manner. Damage during turnover can be avoided. A turnover may be performed very reliably. By turning the tool over using a swivel plate that forms part of a table assembly, restrictions for turnover operations can be largely avoided. A turnover may also be extremely time-efficient. A turnover may also be performed at almost all stages of workpiece machining and/or for very different workpiece geometries.

The flat material may be sheet metal, specifically a metal sheet, for example, but it may also be another material, in particular a material that can be plastically formed. The machine tool may be a sheet metal forming machine. In one embodiment of the invention, the machine tool is a bending machine, in particular a long folding machine. The bending machine may, for example, be a single bending machine or a double bending machine. In other embodiments, the machine tool may be a press, a punching machine, a bending machine or the like. In general, the invention can be used with machine tools which can use and/or use a workpiece table as described herein. In principle, the invention extends to machines including, without limitation, two-column machines in which the workpiece table may extend to a rear side of the machine or in which the workpiece table is accessible over an entire bending length from two opposite sides, i.e. from the front and from the rear. In this case, the turnover device may be arranged on the rear side. In other words, when viewed from a side from which the machine can be loaded, the swivel plate may be arranged behind the base plate. The workpiece may then be turned over behind the machining tool, for example.

The workpiece can be clamped in a clamping plane. The clamping plane may be defined by the supporting area. The base plate and/or the swivel plate may have an at least substantially closed surface. The base plate and/or the swivel plate may define the supporting area in other ways, for example by providing suitable supporting points. For example, the base plate and/or the swivel plate may, at least in sections, be configured as a grid, grille, net or with perforations, ribs, studs, etc. Within the scope of this disclosure, the term "plate" can primarily be understood functionally.

The machine tool and/or workpiece table may comprise several table assemblies collectively defining the supporting area. The machine tool and/or the workpiece table may comprise different table assemblies. For example, at least one table assembly including a swivel plate and at least one further table assembly not including a swivel plate may be provided. The table assembly or table assemblies may functionally form a table onto which the workpiece can be placed.

In particular, the workpiece is turned over in such a way that one side of the workpiece, which represents a bottom side lying on the supporting area before turnover, represents a top side facing away from the supporting area after turnover. In other words, a distinction may have to be made between turning over and simply turning where an orientation of the workpiece is changed while its top side remains unchanged. The turnover may be performed around an axis lying in a main plane of extension of the workpiece. The swivel movement takes place in particular from a plane defined by the supporting area.

In some embodiments, the machine tool and/or the workpiece table and/or the table assembly may comprise a turning unit that can be used to turn the workpiece. Accordingly, the method according to the invention may comprise a step in which the workpiece is turned. The turn may be performed independently of a turnover. The turn is performed, for example, about an axis which is at least substantially perpendicular to the workpiece's main plane of extension.

The workpiece table may be configured as a module. A modular workpiece table can be used for different types of machines. Alternatively, the workpiece table may be integrated with other components of the machine tool.

The machine tool and/or the workpiece table preferably comprise a control unit configured to control different components and thus to implement, for example, a semi-automated or automated control system. Especially if the workpiece table is configured as a module, it may have its own control unit that is connectable to a control unit of the machine tool and/or configured to exchange data with and to receive, for example, instructions from it.

Especially if the machine tool is configured as a long folding machine, it preferably comprises a first clamping jaw and/or a second clamping jaw. The clamping jaws may be configured as plates and/or be plate-shaped. The clamping jaws may be inclined away from a bending area and define a tapered receiving area. In the clamped state, for example, a clamped portion of the workpiece rests on the supporting area in the receiving area. A portion of the workpiece to be bent may protrude between the clamping jaws from the receiving space. When the portion to be bent is bent around a bending axis, it is swiveled relative to the clamping jaws. The clamping jaws preferably define the bending axis.

The machining unit comprises in particular a machining tool that is movable relative to the workpiece table. The machining unit may be arranged on a clamping jaw. In the case of a long folding machine, for example, this allows bending to be performed by the bending unit moving its machining tool towards the workpiece and/or exerting a tensile force on the workpiece.

Restrictions due to limited space during turnover may be avoided in particular and/or a high degree of freedom with regard to workpiece geometries to be turned over may be achieved in particular if the machine tool comprises a receiving area in which the workpiece is arranged and/or can be arranged at least in sections during machining, wherein the swivel plate is arranged and/or can be arranged outside the receiving area for turnover. Viewed from the machining tool, the receiving area may be arranged behind the mentioned clamping jaws. The mentioned clamping jaws may provide access to the receiving area, for example when being moved away from one another. Turnover may take place towards the receiving area. Preferably, turnover takes place completely outside the receiving area. It is understood that, depending on the machine's design, the swivel plate may be arranged in front of or behind the receiving area. The terms "in front of" and "behind" may refer to a front of the machine. This may be defined by a side from which loading takes place in normal operation and/or by a side on which the workpiece portion to be bent is located during bending.

In one embodiment, the machining unit is configured to bend a workpiece portion to be bent relative to a clamped workpiece portion about a bending axis. The swivel movement of the swivel plate may be defined by at least one swivel axis arranged at least substantially parallel to the bending axis. This may help to achieve a high level of efficiency, for example because no unnecessarily extensive additional movements of the workpiece are required when being turned over between bending operations. The bending axis is preferably located within close range a plane defined by the supporting area. The close range may, for example, be an area whose included points are no more than 5 cm, preferably no more than 2 cm and particularly preferably no more than 1 cm away from the plane. If the swivel movement of the swivel plate is described by a specific movement path deviating in particular from a circular path, the movement path may run in a plane that is perpendicular to the bending axis.

Damage-free and controlled turnover may be achieved in particular if the table assembly comprises a holding unit configured to keep the workpiece stationary relative to the swivel plate for turnover so that the workpiece, when held, follows a movement of the swivel plate. This may also be achieved in particular if in the method according to the invention, the workpiece is kept stationary relative to the swivel plate during turnover. The holding unit may have at least one holding member. The holding member may be part of the swivel plate. Preferably, the holding member is configured to exert a holding force, for example a mechanical and/or hydraulic and/or magnetic and/or pneumatic holding force, on the workpiece in a holding state.

The holding unit may have at least one controllable drive. The drive of the holding unit may be pneumatic and/or hydraulic and/or electric. In some embodiments, the drive is a threaded spindle drive. The holding unit may further have a force transmission through which an actuating force can be transmitted from the drive to at least one holding member, such as a chain transmission and/or a Bowden cable and/or a linkage and/or a belt and/or a gearbox.

The holding unit may be configured to hold the workpiece by means of negative pressure. For example, the holding unit can comprise one or more suction grippers and/or suction cups. A negative pressure line may be provided which runs through the base plate to the swivel plate and which is connected, for example, to a device generating negative pressure, such as a vacuum pump, preferably via at least one suitably controllable shut-off valve. The device generating negative pressure may be attached to and/or be part of a frame of the table assembly and/or the bending machine. In other embodiments, one or more negative pressure generators may be provided in the swivel plate, such as mechanically and/or hydraulically actuated suction grippers.

Alternatively or additionally, the holding unit may be configured to hold the workpiece magnetically. For example, the holding unit and/or the swivel plate may comprise at least one switchable magnetic element, such as an electromagnet, that can be switched between a holding state and a release state.

According to one embodiment, the holding unit comprises at least one holding member that is movable relative to the swivel plate and configured to selectively clamp and release the workpiece on the swivel plate. The holding member that is movable relative to the swivel plate may, for example, be a holding claw that is pivotable towards the workpiece for clamping. Several holding members that are movable collectively and/or individually may be provided, for example to specifically hold the workpiece in certain areas depending on its geometry.

In particular if the machine tool and/or the workpiece table comprise a movement device configured to automatically generate the swivel movement of the swivel plate, a high degree of reliability and/or efficiency can be achieved. In some embodiments, the movement device may generate the swivel movement from a movement of the table assembly and/or from a movement of the machining tool. The movement device may be configured to swivel the swivel plate according to a predetermined movement plan. The movement plan may, for example, include a target swivel angle and/or a speed profile for a change in swivel angle over time. The swivel movement may generally be parameterized by at least one swivel parameter. The swivel parameter may be, for example, an angle between the portions of the supporting area that define the base plate or the swivel plate. Alternatively or additionally, the swivel parameter may indicate a position along a swivel trajectory. The movement plan may be based on a course of the at least one swivel parameter over time. It may be possible to specify how far and/or how fast the swivel plate is swiveled relative to the base plate.

The movement device may comprise a separate drive for the swivel plate, which has proven to be an advantage, for example, when the workpiece table is configured as a module. The separate drive may be controlled by the control unit. The drive may be pneumatic and/or hydraulic and/or electric. For example, it may be an electric motor, a hydraulic cylinder, a linear actuator or the like, combined with a suitable gearbox if necessary. In some embodiments, the drive is a threaded spindle drive. The movement device may comprise a force transmission configured to transmit an actuating force for generating the swivel movement from a location away from the swivel plate to the swivel plate. The force transmission may, for example, comprise a chain transmission and/or a Bowden cable and/or a linkage and/or a belt and/or a gearbox and/or a compressed air line and/or a hydraulic line.

According to one embodiment, the movement device comprises at least one force transducer that converts a generated actuating force into a force required to generate the swivel movement. The force transducer may be a lever, for example. This allows a drive force to be suitably adapted, which means that almost any type of actuator can be used. The force transducer causes in particular a reduction or transmission of a force applied.

Targeted utilization of existing drive power and the related low additional structural effort as well as high cost efficiency due to multifunctional components may be achieved in particular if the machining unit and preferably the machining tool are configured to provide an actuating force to generate the swivel movement. In some embodiments, it may be provided that an actuating force of the machining unit and/or a movement of the machining tool can be applied specifically to a force introduction portion. The force introduction portion may be part of the movement device. The swivel plate may thus be swiveled by actuating the machining unit and/or moving the machining tool. For this purpose, the machining unit may, for example, be brought into an actuated state in which specific interaction with the force introduction portion is caused, for example by positioning the machining tool on the force introduction portion. The machining tool may then exert a tensile force and/or a compressive force on the force introduction portion. The force introduction portion may further have several different force introduction members, for example a force introduction member for causing the swivel plate to swivel and/or a force introduction member for causing the swivel plate to swivel back, for example from a swiveled state to a non-swiveled state.

The swivel plate may be pivotable from a non-swiveled state by at least 90 degrees, preferably by at least 120 degrees and in particular by 180 degrees. The specified angle may refer to an angle between the portions of the supporting area that define the swivel plate or the base plate.

Performing a full, controlled turnover is possible especially when in a state in which the swivel plate is swiveled to a maximum degree, a gap remains between the swivel plate and the base plate, in particular a gap having a thickness of at least 3 mm, preferably of at least 4 mm and particularly preferably of at least 5 mm. The gap is preferably adapted to a maximum thickness of the workpiece. In the state in which the swivel plate is swiveled to a maximum degree, a workpiece portion held in place may be arranged in the gap. This allows the workpiece to be turned over by 180 degrees without having to fall or slide to a significant extent.

According to one embodiment, the table assembly comprises at least one coupling, in particular a coupling joint, which pivotably couples the swivel plate to the base plate. This makes it possible to define an almost arbitrary movement path for the swivel plate and thus achieve a high degree of flexibility with regard to workpieces that can be handled. The coupling may define a single swivel axis and/or an arc-shaped movement path for the swivel plate and be configured as a swivel joint, for example. In other embodiments, the coupling may define a swivel plate movement path that deviates from a circular path. This can be achieved, for example, with a suitable coupling joint or coupling gear comprising several elementary joints.

As mentioned, the machine tool may comprise a machine frame. The table assembly can be linearly movable relative to the machine frame. In particular, the table assembly is linearly movable parallel to the supporting area and/or perpendicular to the bending axis. The table assembly can be advanced and retracted between the clamping jaws. The table assembly is at least partially extendable from the receiving space, meaning that extending may increase a distance between the swivel plate and the clamping jaws and/or the machining unit.

In one embodiment, the movement device is configured to generate the swivel movement of the swivel plate from a movement of the table assembly relative to the machine frame. For this purpose, the base plate may have a force introduction member that transmits a force to the swivel plate via force transmission when the force introduction member comes into contact with a stationary component of, for example, the machine frame. In some embodiments, a stop may be provided against which the force introduction member rests when the table assembly is advanced beyond a certain point. Advancing the table assembly may then be directly accompanied by swiveling the swivel plate. In other embodiments, a suitable force introduction member may also be available on the swivel plate, which causes the swivel plate to swivel when the table assembly is moved.

In addition, in one embodiment it is provided that the machine tool and/or workpiece table comprises a handling device configured to move the workpiece relative to the table assembly, in particular perpendicular to the bending axis and/or parallel to the supporting area, for handling before, during and/or after machining and to fix the workpiece as required, wherein the handling device comprises at least one handling member configured to mechanically act on the workpiece to move, in particular advance, it onto the swivel plate before turnover, and/or to at least partially move, in particular retract, it from the swivel plate onto the base plate after turnover. The method according to the invention may comprise moving, in particular advancing, the workpiece onto the swivel plate such that the entire workpiece is removed from, in particular pushed off, the base plate before the swivel movement for turning the workpiece over is generated. The method may further comprise moving the workpiece back, in particular pulling it back, onto the base plate at least partially, in particular after completed turnover. As the entire workpiece is moved onto the swivel plate, it may be swiveled in a controlled manner, being able to move with the swivel plate without hindrance.

Below, the present invention is described by way of example with reference to the accompanying figures. The drawing, the specification and the claims contain combinations of numerous features. The skilled person will appropriately consider the features also individually and use them in useful combinations within the scope of the claims. In the drawings:

Figure 1:
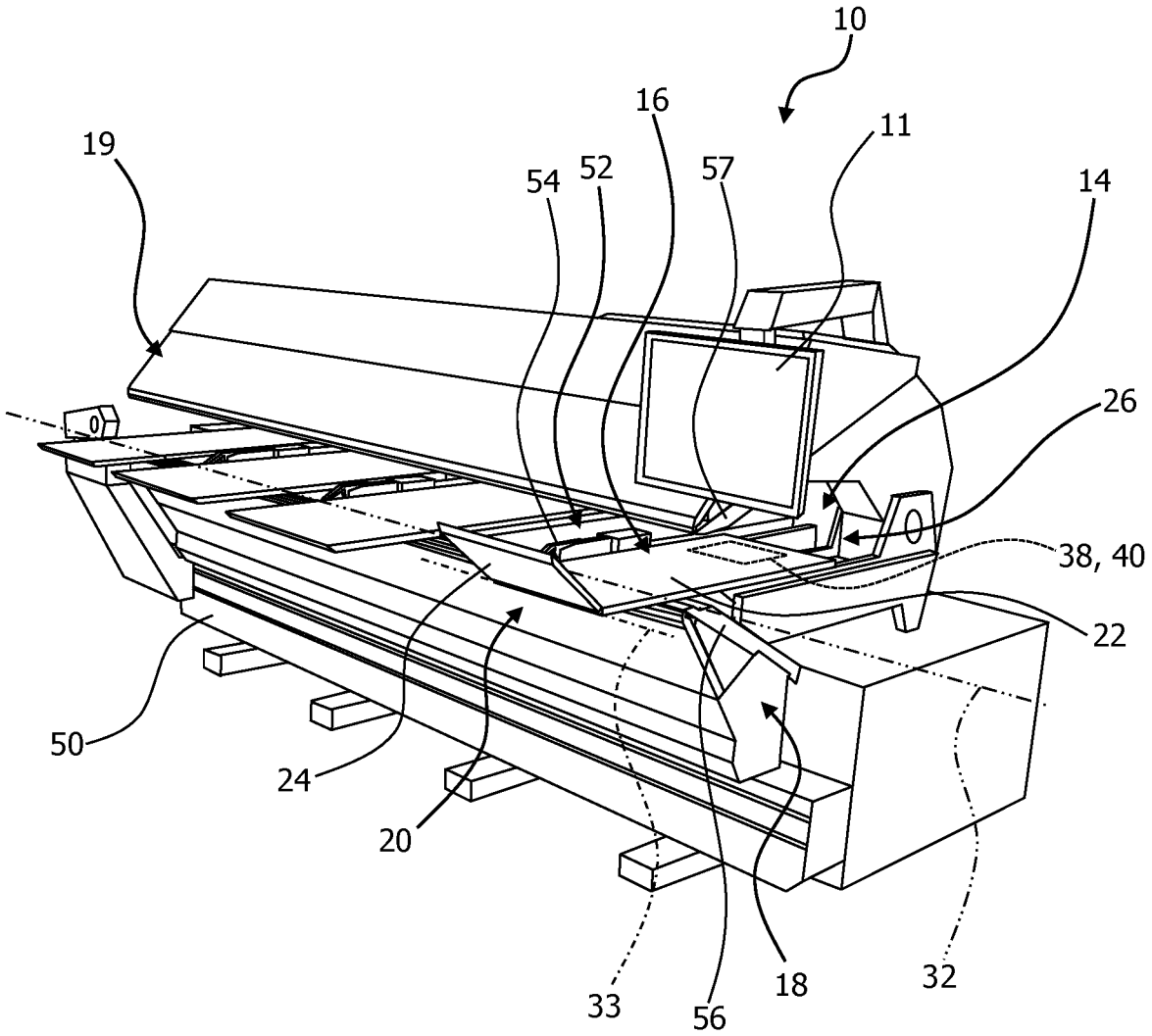
FIG. 1 is a schematic perspective representation of a machine tool comprising a workpiece table.

FIG. 1 is a schematic perspective representation of a machine tool 10 according to the invention. In this exemplary embodiment, the machine tool 10 is configured as a long folding machine. However, the specification below is to be understood as meaning that in other embodiments, the machine tool 10 can also be a press, punching machine, bending machine, etc.

Figure 2:
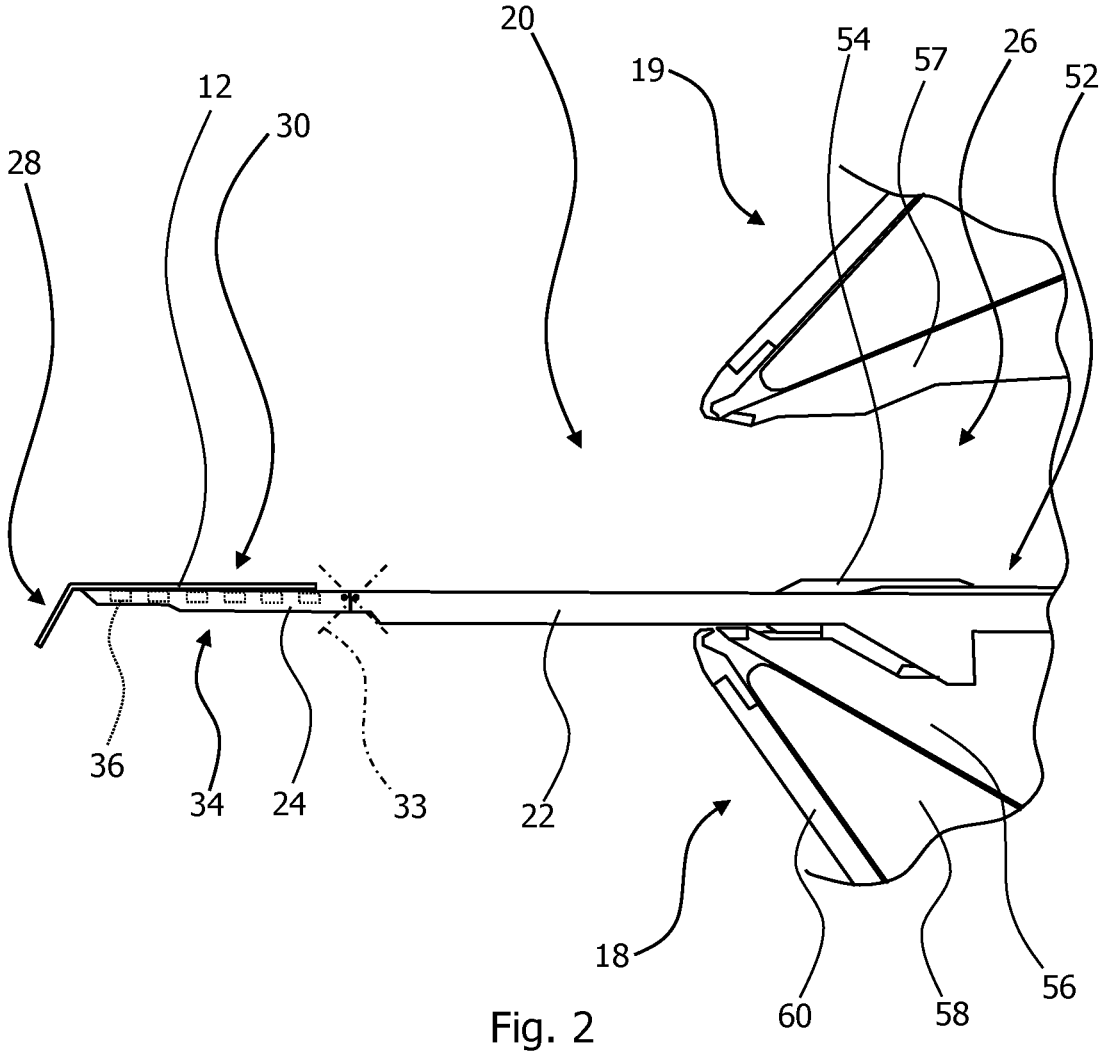
FIG. 2 is a schematic side view of a section of the machine tool comprising a workpiece table in a totally non-swiveled state.

The machine tool 10 is configured to machine a workpiece 12 (cf. FIG. 2). In the present case, the machine tool 10 is configured to machine a workpiece 12 made of flat material, such as sheet metal, as is known by bending it several times about a bending axis 32. The machine tool 10 has a machine frame 50. The machine tool 10 further has a workpiece table 14 defining a supporting area 16 on which the workpiece 12 can be placed during machining.

The machine tool 10 comprises a control unit 11. It may be connected to a display device that serves as a user interface or is part of such a user interface. It is understood that the functions of the machine tool 10 described below can be controlled by the control unit 11. Accordingly, the control unit 11 may comprise a computer-readable medium with suitable program code.

The machine tool 10 further comprises a clamping jaw 56 and another clamping jaw 57 which can be used to clamp the workpiece 12 in place during machining. At least one of the clamping jaws 56, 57 is movable relative to the machine frame 50. In the case illustrated, the other clamping jaw 57, configured as an upper clamping jaw, can be swiveled upwards relative to the machine frame. In addition, at least one of the clamping jaws 56, 57 can be linearly and/or pivotably movable relative to the workpiece table 14.

The machine tool 10 defines a receiving area 26 in which the workpiece 12 is arranged at least in sections during machining. In the case illustrated, the receiving area 26 is arranged between the clamping jaws 56, 57. During machining, the workpiece partially protrudes between the clamping jaws 56, 57 from the receiving area 26. This defines a clamped portion 30 and a portion 28 of the workpiece 12 to be bent. In FIG. 2, these two portions 28, 30 each have a reference sign, wherein it is understood that bending of the workpiece 12 about the bending axis 32 has already taken place to obtain the workpiece geometry shown in FIG. 2. This means that for this purpose, the portion 28 to be bent was bent downwards relative to the clamped portion 30.

The machine tool 10 comprises a machining unit 18 and another machining unit 19. They are briefly described with reference to FIG. 2. The machining unit 18 is attached to the clamping jaw 56. The machining unit 18 comprises a base member 58. In the case illustrated, the base member 58 is wedge-shaped. The base member 58 is mounted for linear movement on a surface of the clamping jaw 56. The machining unit 18 further comprises a machining tool 60. The machining tool 60 is again mounted for linear movement on a surface of the base member 58. A movement path of the machining tool 60 can thus be generated by moving the base member 58 relative to the clamping jaw 56 and/or the machining tool 60 relative to the base member 58. DE 10 2018 000344 B3, for example, describes how such a bending unit works.

In the illustrated case, moreover, the further bending unit 19 is attached to the further clamping jaw 57. The further bending unit 19 is constructed in the same way as the bending unit 18. The two bending units 18, 19 can thus be used to bend the workpiece either upwards or downwards about the bending axis 32.

In the following, reference is made once more to FIG. 1. The workpiece table 14 comprises at least one table assembly 20 having a base plate 22 and a swivel plate 24. In the case illustrated, the workpiece table 14 comprises several table assemblies. They can be configured identically or differently. It may, in particular, be provided that only some or one of the table assemblies have a swivel plate.

The base plate 22 and the swivel plate 24 each define a portion of the supporting area 16. The swivel plate 24 is pivotably mounted relative to the base plate 22 in such a way that a swivel movement can be generated which can be used to turn the workpiece 12 over. Upon turning the workpiece 12 over, its top side is turned downwards and its bottom side is turned upwards.

The swivel plate 24 forms a front end of the table assembly 20. In other words, the swivel plate 24 defines a region at the very front of the supporting area 16. The term "front" refers to the side of the bending machine 10 on which the machining units 18, 19 are arranged. The machine tool 10 is loaded from this side.

In other embodiments, the swivel plate may form a back end of the table assembly. This may be the case, for example, in machines whose workpiece table is accessible from both the front and the rear. If, for example, for a specific machining operation, the workpiece is intended to be placed onto the workpiece table from a first side of the machine, the swivel plate may be arranged behind the base plate when viewed from this first side. The swivel plate may be arranged on a second side of the machine, which is opposite the first side.

The table assembly 20 is linearly movable relative to the machine frame 50. Specifically, the table assembly 20 may be movable perpendicular to the bending axis 32. The table assembly 20 may be partially moved out of the receiving area 26 and/or moved back into it.

In the case of the long folding machine illustrated, to bend the workpiece 12, the table assembly 20 is moved back to the point that only the workpiece 12 protrudes from between the clamping jaws 56, 57. A respective protruding portion to be bent can thus be bent upwards or downwards towards one of the clamping jaws without the table assembly 20 impeding the bending movement.

The machine tool 10 or the workpiece table 14 further comprises a handling device 52. It is configured to move the workpiece 12 relative to the table assembly 20. In the case illustrated, several handling devices 52 are present, only one having a reference sign. The handling device 52 has a handling member 54 configured to mechanically act on the workpiece 12. For example, the handling member 54 is pivotable towards the surface of the workpiece 12 and/or can be lifted away from it, which makes it possible to selectively hold the workpiece 12 on the supporting area 16. In addition, the handling member 54 may be movable relative to the table assembly 20, which makes the workpiece 12 movable in the supporting area 16. Using the handling device 52, the workpiece 12 can be pushed forwards or pulled backwards on the table assembly 20, for example to move it out of the receiving area 26. The handling device 52 may further be used to hold the workpiece 12 on the supporting area 16 during machining.

Figure 3:
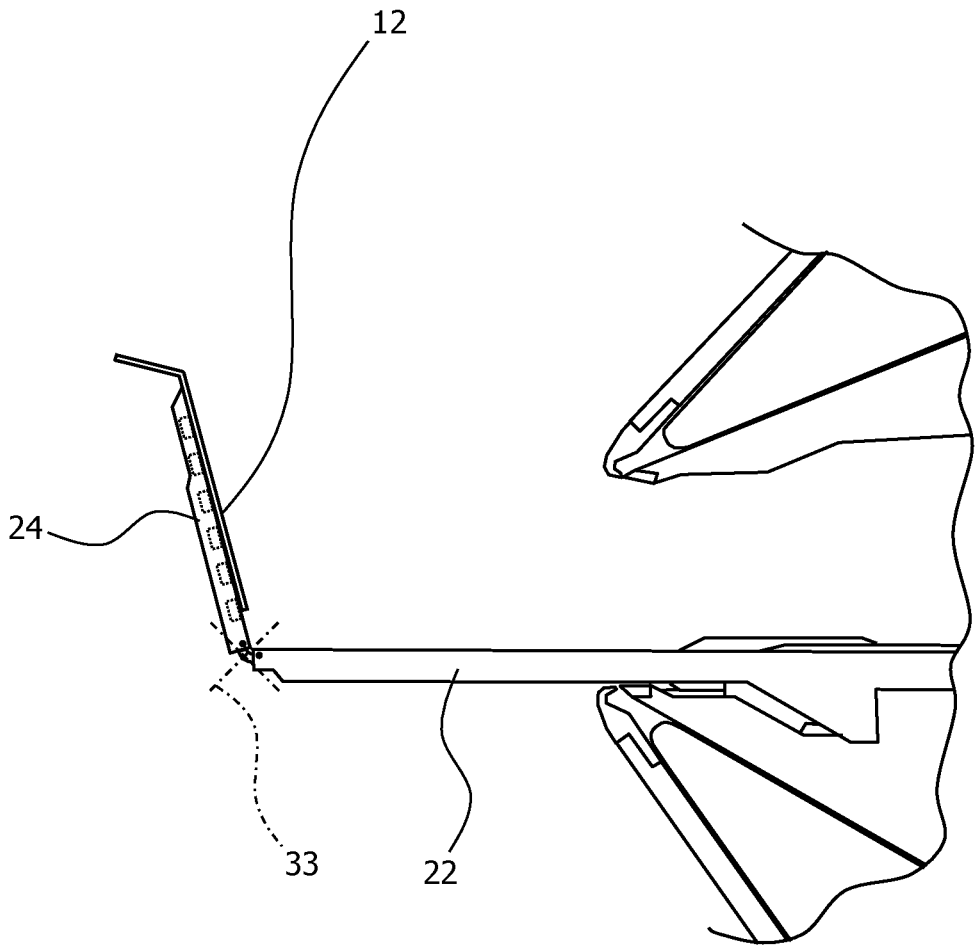
FIG. 3 is a schematic side view of a section of the machine tool comprising a workpiece table in a partially swiveled state.
Figure 4:
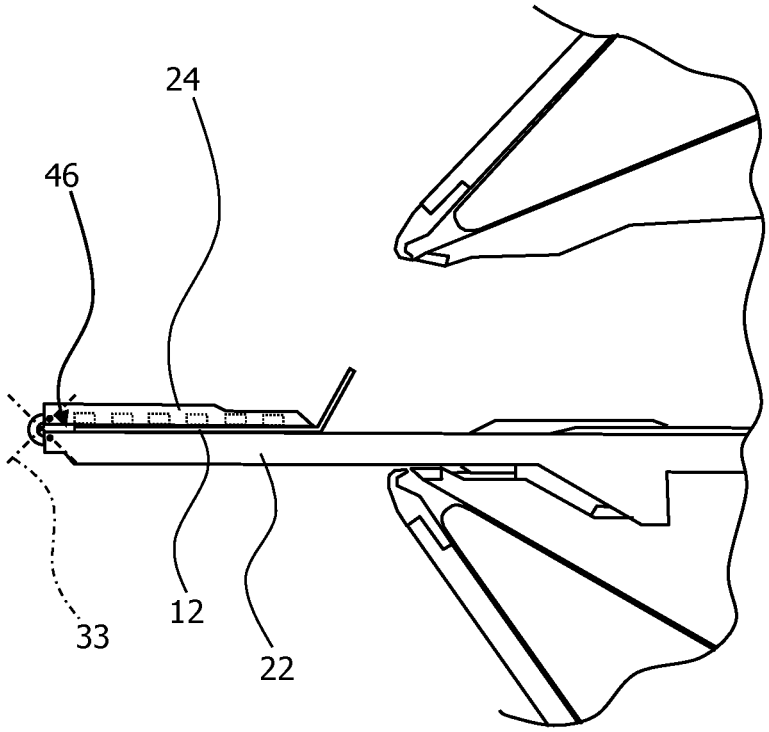
FIG. 4 is a schematic side view of a section of the machine tool comprising a workpiece table in a fully swiveled state.

FIG. 2 to FIG. 4 illustrate a section of the machine tool 10. The representations serve to illustrate turnover of the workpiece 12. In FIG. 2 to FIG. 4, some reference signs have been omitted for the sake of clarity.

Before turnover, the workpiece 12 is completely pushed forwards onto the swivel plate 24. Then, it no longer rests on the portion of the supporting area 16 defined by the base plate 22. This may be performed when the table assembly 20 is retracted, for example with the handling device 52.

The table assembly 20 comprises a holding unit 34. The holding unit 34 comprises one or more holding members 36, only one having a reference sign for the sake of clarity. The holding members 36 are configured on or in the swivel plate 24. In the embodiment shown, the holding members 36 are suction cups. They are connected to a negative pressure generator, e. g. a vacuum pump or the like, via compressed air lines (not illustrated) running through the swivel plate 24 and the base plate 22. The negative pressure generator is arranged, for example, on the machine frame 50.

In other embodiments, a movable clamping device that can selectively fix the workpiece 12 to the swivel plate 24 mechanically may serve as the holding member. According to the invention, switchable and/or magnetic holding members may also be used.

Irrespective of the exact design of the holding member 36, it is configured to either keep the workpiece 12 stationary relative to the swivel plate 24 or to release it. When held, the workpiece 12 moves with the swivel plate 24 when the latter is swiveled. The swivel movement of the swivel plate 24 may thus serve as a turnover movement for the workpiece 12. When released, on the other hand, the workpiece 12 is movable relative to the swivel plate 24.

Starting from the totally non-swiveled state of the swivel plate 24 as shown in FIG. 2, in which the workpiece 12 is fully advanced onto the swivel plate, the swivel plate 24 is swiveled about a swivel axis 33. As a result, a bottom side of the workpiece 12, which rests on the swivel plate 24, becomes the new top side of the workpiece 12 while a top side of the workpiece 12 rests on the base plate 22, being the bottom side after turnover. The swivel axis 33 is arranged parallel to the bending axis 32.

Figure 7:
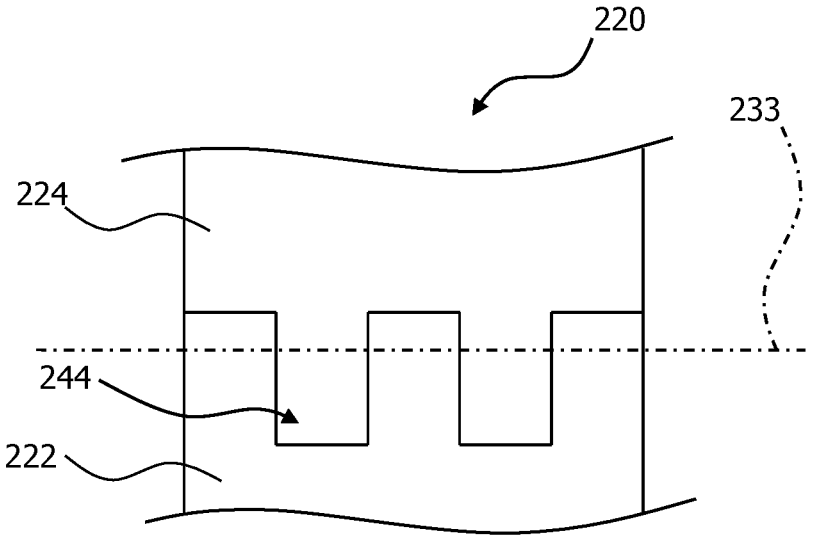
FIG. 7 is a schematic top view of a section of the table assembly according to the further alternative embodiment.

As can be seen in FIG. 7, a gap 46 is formed between the base plate 22 and the swivel plate 24 when the swivel plate 24 is fully swiveled. This gap 46 can be several millimeters thick so that the workpiece 12 may be accommodated in the gap 46 when the swivel plate 24 is fully swiveled. The swivel movement of the swivel plate 24 may thus be performed to such an extent that the workpiece 12 is completely turned over before being released by the holding unit 34. In the case illustrated, a maximum swivel angle of 180° is provided.

In other embodiments, the gap 46 may be omitted and/or the maximum swivel angle may be smaller.

Turning the workpiece 12 over may include the workpiece 12 being released by the holding unit 34 and the workpiece 12 subsequently sliding and/or falling onto the base plate 22. This may occur if the entire available swivel angle is not utilized or even if the maximum swivel angle is less than 180°.

In the following, reference is made once more to FIG. 1. The machine tool 10 comprises a movement device 38 configured to automatically generate the swivel movement of the swivel plate 24. The movement device 38 may be connected to the control unit 11. In the case illustrated, the movement device 38 comprises a separate drive 40. The movement device 38 and the separate drive 40 are only shown schematically. Various drives can be used, such as hydraulic cylinders, air cylinders, threaded spindles, gearboxes with various drives, linear actuators, etc.

In the exemplary embodiment according to FIG. 1, the separate drive 40 is arranged at a distance from the swivel plate 24. The movement device 38 hence comprises a force transmission such as a Bowden cable, a hydraulic line, a compressed air line, a belt, a chain, a gearbox or the like to transmit an actuating movement generated by the separate drive 40 to the swivel plate 24.

Alternatively, a separate drive may be provided directly on and/or in the swivel plate 24. For example, an electric motor may be provided directly in the area of an articulated connection of the swivel plate 24 to the base plate 22, which can optionally be supplied with electrical energy to generate the swivel movement of the swivel plate 24.

Further variants relating to the generation of the swivel movement of the swivel plate 24 are described below with reference to FIG. 6 to FIG. 9.

Figure 5:
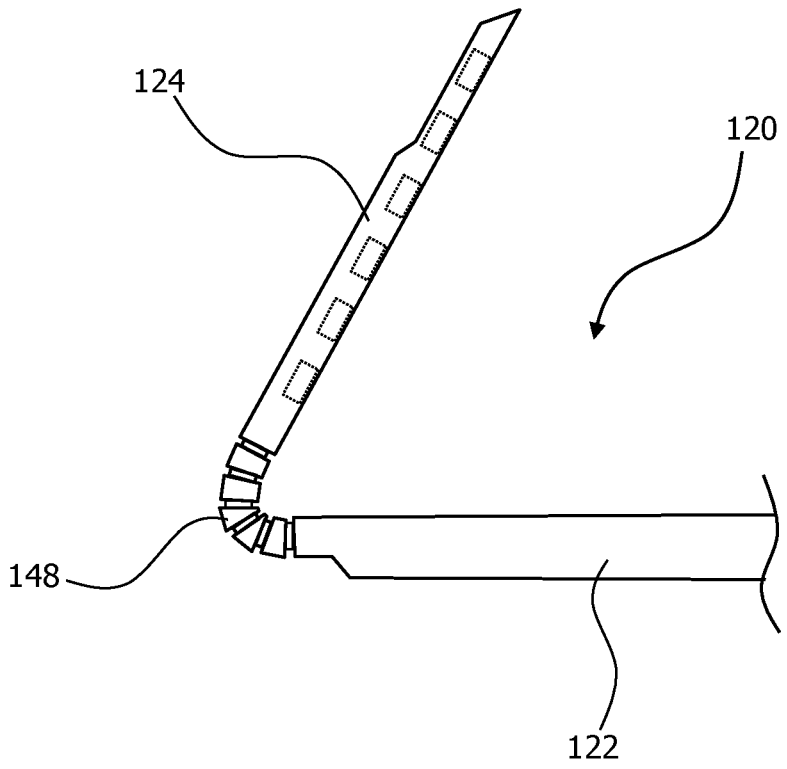
FIG. 5 is a schematic side view of an alternative embodiment of a table assembly of a workpiece table.

FIG. 5 shows a further embodiment of a table assembly 120. It may be used as an alternative to the table assembly 20 described above. Similarly, the table assembly 120 comprises a base plate 122 and a swivel plate 124. The table assembly 120 comprises a coupling joint 148 that pivotably couples the swivel plate 124 to the base plate 122 and that defines a movement path of the swivel plate 124 that deviates from a circular path. The coupling joint 148 is only shown schematically, and its individual joints are not shown in detail. The coupling joint 148 may be configured in any suitable manner and may include a plurality of rigid members connected by joints. The coupling joint 148 may be a spatial mechanism. A complex swivel movement may thus be defined, including, for example, a sweeping movement preventing the workpiece 12 from being pinched at an edge during turnover.

In one embodiment, the coupling joint 148 is adjustable so that the movement path is variable. This may be automated or manual. The swivel movement may thus be adjustable to the geometry of a workpiece to be turned over so that it can be turned over in a targeted and/or damage-free manner even if it has already been machined and has one or more bending points, for example.

Figure 6:
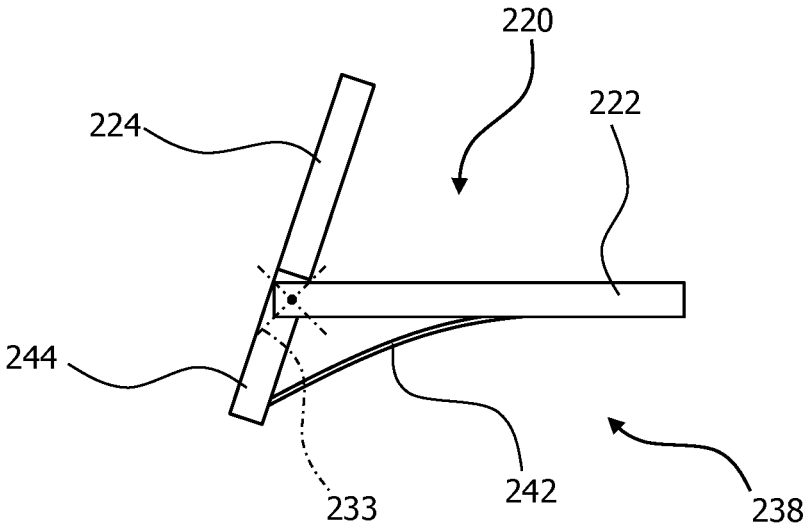
FIG. 6 is a schematic side view of a further alternative embodiment of a table assembly of a workpiece table.

FIG. 6 and FIG. 7 illustrate another embodiment. This embodiment uses a table assembly 220 having a base plate 222 and a swivel plate 224 mounted on it so as to swivel about a swivel axis 233. The table assembly 220 comprises a movement device 238 with a force transmission 242 configured to transmit an actuating force for generating the swivel movement from a location away from the swivel plate 224 to the swivel plate 224. The force transmission 242 is shown by way of example only and may be configured to transmit a tensile force and/or a compressive force. As mentioned above, any suitable force transmission may be used. In general, according to the invention it may also be provided that the swivel plate 224 is spring-biased, in particular damped, and automatically returns into its totally non-swiveled state, for example if there is no actuating force, or automatically moves into a state in which it is swiveled to a maximum degree if there is no actuating force.

As in the embodiment described above, the movement device 238 may comprise a separate drive. An actuating force provided by the separate drive may then be transmitted to the swivel plate 224 through the force transmission 242.

In the embodiment according to FIG. 6 and FIG. 7, the movement device 238 further comprises a force transducer 244. Such force transducer 244 converts an actuating force for generating the swivel movement of the swivel plate 224. In the example illustrated, the force transducer 244 is a lever. It is formed by the swivel plate 244 itself. The force transducer 244 protrudes beyond the swivel axis towards the base plate 222. This protrusion may be used as a lever as the force transmission 242 engages it. As schematically illustrated in FIG. 7, there may be several protrusions, for example if force is to be transmitted to the swivel plate 224 at several points.

In certain embodiments, the machining unit 18 and/or the machining unit 19 may be configured to provide an actuating force to generate the swivel movement. It is understood that this may also be the case for other types of machine tools and correspondingly differently configured machining units. For this purpose, a movement device may be designed in such a way that a movement provided by the corresponding machining unit is transmitted to the swivel plate. In the implementations according to FIG. 6 and FIG. 7, for example, the machining unit 18 may act on an end of the force transmission 242 that is not shown.

Figure 8:
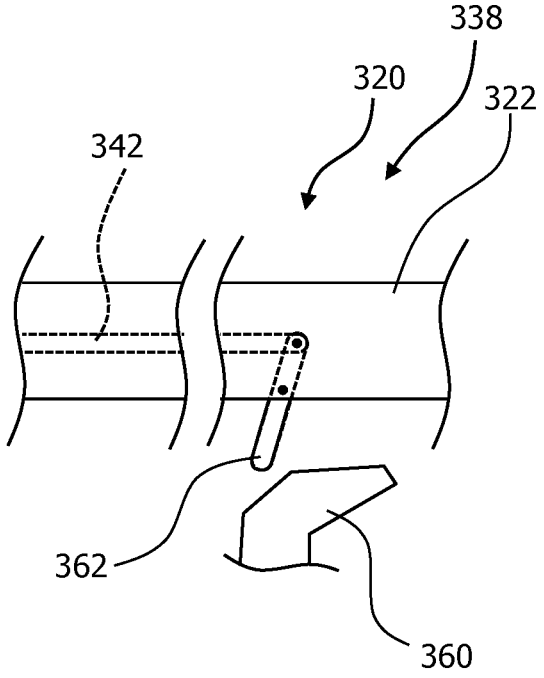
FIG. 8 is a schematic representation of a section of yet another alternative embodiment of a table assembly.
Figure 9:
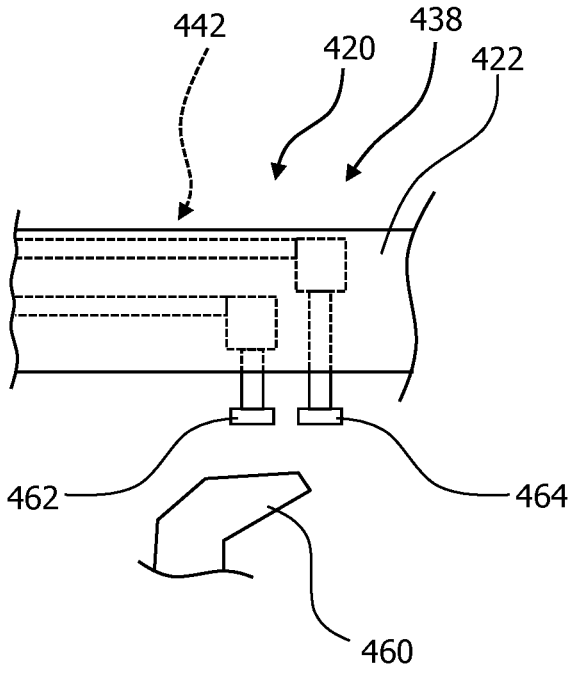
FIG. 9 is a schematic representation of a section of yet another alternative embodiment of a table assembly.

FIG. 8 and FIG. 9 schematically show embodiments in which a machining unit serves to provide the actuating force for the swivel plate. Each of the figures shows a portion of a base plate 322, 422 of a table assembly 320, 420. A swivel plate is connected to each of them, as described above in connection with other implementations.

In the embodiment according to FIG. 8, a movement device 338 comprises a force introduction member 362 configured to enable the introduction of force from a machining unit. In the case illustrated, the force introduction member 362 is configured as a lever on which a machining tool 360 of a machining unit not shown in more detail can act. The force introduction member 362 is mounted on the base plate 322 such that it can be swiveled in two directions. Moving the force introduction member 362 in a first direction causes the swivel plate to swivel towards the base plate 322 while moving it in the opposite direction causes the swivel plate to swivel back into its totally non-swiveled state. The schematically illustrated force transmission 342 may, for example, be a linkage. However, one or more hydraulic lines, Bowden cables, belts, chains, etc. may also be used, in combination if applicable.

In the embodiment according to FIG. 9, a movement device 438 comprises a force introduction 442 comprising two force introduction members 462, 464. Each of them is configured as a hydraulic cylinder and connected to a separate hydraulic line leading to the swivel plate not shown and connected to an actuating mechanism for the swivel plate. It may also be provided that each of the force introduction members is a lever actuating a linkage or the like. Furthermore, the force introduction members may be connected to Bowden cables. The force introduction members 462, 464 are each arranged and configured such that a machining tool 460 of a machining unit not shown in more detail can act on them. Actuation of a first force introduction member 462 causes the swivel plate to swivel towards the base plate 422. Actuation of a second force introduction member 462 causes the swivel plate to swivel back into its totally non-swiveled state. The force introduction members 462, 464 may optionally be configured to react to a compressive force or a tensile force applied by the machining tool 460.

Instead of the machining unit acting on a force introduction member, one or more stops acting on a force introduction member upon movement of the table assembly 20 relative to the machine frame 50 may be provided. The swivel movement is then generated by moving the table assembly 20. The corresponding force introduction member may be arranged either directly on the swivel plate 24 or on a force transmission's end spaced from it.

Figure 10:
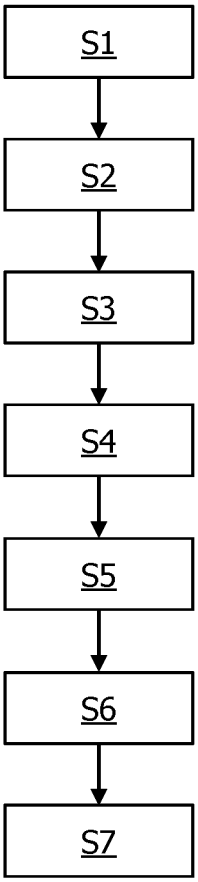
FIG. 10 is a schematic flow chart of a method for machining a workpiece made of flat material.

FIG. 10 is a schematic flow chart of a method for machining a workpiece made of flat material. Below, the method is explained by way of example for implementation using the machine tool 10 described above. However, it is understood that the method can also be performed using another machine tool having a corresponding workpiece table.

In method step S1, the workpiece 12 is placed onto the supporting area 16.

In method step S2, the workpiece 12 is machined. For example, the workpiece 12 is bent downwards about the bending axis 32.

In an optional method step S3, the workpiece 12 is advanced onto the swivel plate 24 such that the entire workpiece is pushed off the base plate 22. This is performed with the handling device 52, for example. Alternatively or additionally, the optional method step S3 may include extending the table assembly 20.

In an optional method step S4, the workpiece 12 is temporarily fixed to the swivel plate 24. This can be done, for example, with the holding unit 34 described above.

In method step S5, a swivel movement of the swivel plate 24 is generated to turn the workpiece 12 over. The swivel plate 24 may be arranged outside the receiving area 26. The workpiece 12 can thus be swiveled completely outside the receiving area 26. If the workpiece 12 is temporarily fixed to the swivel plate 24, it completely follows the movement of the swivel plate 24. In other variants, it may also be provided that the workpiece 12 can move relative to the swivel plate 24. For example, the workpiece 12 can then be turned over by resting one of its edges against a holding member spaced from the swivel plate 24 and thus ensuring that the workpiece 12 slides relative to the swivel plate 24 rather than being moved in an uncontrolled manner.

In an optional method step S6, the workpiece 12 is partially retracted or pushed back onto the base plate 22 as required. Alternatively or additionally, the optional method step S6 may include retracting the table assembly 20.

In method step S7, the turned-over workpiece 12 is finally machined.

The invention claimed is:

1. A long folding machine for machining a workpiece made of sheet metal, comprising:

a workpiece table defining a supporting area on which the workpiece can be placed at least in sections during machining; and at least one tool for machining the workpiece while the workpiece is placed on the supporting area;

wherein the workpiece table comprises at least one table assembly having a base plate and a swivel plate, the base plate and the swivel plate each defining a portion of the supporting area, wherein the swivel plate is pivotably mounted relative to the base plate in such a way that a swivel movement of the swivel plate can be generated for turning the workpiece over, and wherein the tool is configured to bend a portion of the workpiece to be bent over relative to a clamped portion of the workpiece about a bending axis, and wherein the swivel movement of the swivel plate is defined by at least one swivel axis arranged parallel to the bending axis.

2. The long folding machine of claim 1, further comprising a receiving area in which the workpiece can be arranged at least in sections during machining, wherein the swivel plate is arranged and/or can be arranged outside the receiving area for turnover.

3. The long folding machine of claim 1, wherein the at least one table assembly comprises a holder configured to keep the workpiece stationary relative to the swivel plate for turnover so that the workpiece, when held, follows a movement of the swivel plate.

4. The long folding machine of claim 3, wherein the holder is configured to hold the workpiece by means of negative pressure.

5. The long folding machine of claim 3, wherein the holder comprises at least one holding member that is movable relative to the swivel plate and configured to selectively clamp and release the workpiece on the swivel plate.

6. The long folding machine of claim 1, further comprising a movement device configured to automatically generate the swivel movement of the swivel plate.

7. The long folding machine of claim 6, wherein the movement device comprises a separate drive for the swivel plate.

8. The long folding machine of claim 6, wherein the movement device comprises a force transmission configured to transmit an actuating force for generating the swivel movement from a location away from the swivel plate to the swivel plate.

9. The long folding machine of claim 6, wherein the movement device comprises at least one force transducer that converts a generated actuating force into a force required to generate the swivel movement.

10. The long folding machine of claim 1, wherein the tool is configured to provide an actuating force to generate the swivel movement.

11. The long folding machine of claim 1, wherein the swivel plate is pivotable from a non-swiveled state by at least 90 degrees.

12. The long folding machine of claim 1, wherein in a state in which the swivel plate is swiveled to a maximum degree, a gap remains between the swivel plate and the base plate, wherein the gap has a thickness of at least 3 millimeters (mm).

13. The long folding machine of claim 1, wherein the at least one table assembly comprises at least one coupling joint that pivotably couples the swivel plate to the base plate and that defines a movement path of the swivel plate that deviates from a circular path.

14. The long folding machine of claim 1, further comprising a machine frame, wherein the at least one table assembly is linearly movable relative to the machine frame.

15. The long folding machine of claim 1, further comprising a handling device configured to move the workpiece relative to the at least one table assembly for handling at a time that is one or more of before, during or after machining and to fix the workpiece as required, wherein the handling device comprises at least one handling arm configured to mechanically act on the workpiece to advance it onto the swivel plate before turning it over.

16. A method comprising:

providing a long folding machine for machining a workpiece made of sheet metal, wherein the long folding machine comprises (i) a workpiece table defining a supporting area on which the workpiece can be placed at least in sections during machining, and (ii) at least one tool for machining the workpiece while the workpiece is placed on the supporting area, wherein the workpiece table comprises at least one table assembly having a base plate and a swivel plate, the base plate and the swivel plate each defining a portion of the supporting area, wherein the swivel plate is pivotably mounted relative to the base plate in such a way that a swivel movement of the swivel plate can be generated for turning the workpiece over, and wherein the tool is configured to bend a portion of the workpiece to be bent over relative to a clamped portion of the workpiece about a bending axis, and wherein the swivel movement of the swivel plate is defined by at least one swivel axis arranged parallel to the bending axis;

placing the workpiece onto the supporting area;

machining the workpiece;

generating a swivel movement of the swivel plate to turn the workpiece over; and machining the turned-over workpiece.

17. The method of claim 16, further comprising:

advancing the workpiece onto the swivel plate such that the entire workpiece is pushed off the base plate before the swivel movement for turning the workpiece over is generated.

* * * * *